United States Patent [19]

Wojcieson et al.

[11] 4,341,512

[45] Jul. 27, 1982

[54] BURNER

[75] Inventors: Raymond J. Wojcieson, Annville; Fred L. Fuhrman, Jonestown; John J. O'Hara, Annville, all of Pa.

[73] Assignee: Hauck Manufacturing Company, Lebanon, Pa.

[21] Appl. No.: 174,129

[22] Filed: Jul. 31, 1980

[51] Int. Cl.[3] ..... F23Q 9/00; B05B 1/00

[52] U.S. Cl. ..... 431/284; 239/600; 239/419.3; 239/424

[58] Field of Search ..... 239/600, 419.3, 422, 239/424, 423, 424.5, 400, 406; 431/154, 155, 185, 187, 284, 285; 60/737, 742

[56] References Cited

U.S. PATENT DOCUMENTS

| | | | |
|---|---|---|---|
| 1,569,805 | 1/1926 | Hebert | 239/400 |
| 1,702,298 | 2/1929 | Hetsch | 431/284 X |
| 2,592,297 | 4/1952 | Laguilharre | 239/402.5 |
| 3,039,701 | 6/1962 | Carlisle | 239/419 |
| 3,163,203 | 12/1964 | Ihenfield | 431/284 X |
| 3,273,805 | 9/1966 | Hall | 239/590.3 |
| 3,279,706 | 10/1966 | Kennedy | 239/533 |
| 3,406,912 | 10/1968 | Claffey | 239/533 |
| 3,836,081 | 9/1974 | Yerkins | 239/424.5 |
| 3,896,996 | 7/1975 | Roest et al. | 239/424 |
| 4,003,692 | 1/1977 | Moore | 431/284 X |
| 4,050,633 | 9/1977 | Coursun | 239/550 |
| 4,170,108 | 10/1979 | Mobsby | 60/39.74 R |

*Primary Examiner*—Samuel Scott
*Assistant Examiner*—Randall L. Green
*Attorney, Agent, or Firm*—Thomas Hooker

[57] ABSTRACT

A combination oil and gas fired burner includes a body, an air nozzle and an end plate. The end plate is mounted on the upstream end of the body and holds the air nozzle in place within the body. An atomizing assembly carried by the end plate is fitted within an aperture in the air nozzle adjacent the combustion chamber. The burner is readily disassembled by removing the end plate, atomizing assembly and the air nozzle from the body without requiring complete disassembly and removal of the body from its mounting plate. On the reassembly, fuel and air flow openings in the burner are returned to their original angular orientation so that there is no need to readjust the fuel delivery system.

14 Claims, 7 Drawing Figures

BURNER

The invention relates to a low-capacity combination gas and oil fired burner having an improved construction using a cast body, air nozzle and back plate with an atomizing assembly carried by the back plate. The burner is easily disassembled for servicing by removing the back plate and atomizing assembly from the body and then withdrawing the air nozzle in an upstream direction from the body. There is no need to remove the body from its mounting plate or to disconnect the various air and fuel lines from the body.

Prior low-capacity burners of the type disclosed herein utilize a stacked assembly where burner maintenance required disassembly of the burner from the mounting plate with removal of air, fuel and lines connected to the burner. In contrast, the present burner uses a fixed body construction where the body is semi-permanently mounted on a plate and the air nozzle is fitted within the interior of the body through the open upstream end. A removable end plate carries the atomizing assembly and is bolted to the body to close the upstream end and confine the air nozzle in place within the body. The fixed body construction reduces the time and expense required to disassemble, service and reassemble the burner since the back plate, atomizing assembly and air nozzle are removable from the fixed body without the necessity of removing the body from the support plate and breaking all of the lines attached to the body.

Prior burners used relatively expensive machined and brazed parts in contrast to the inexpensive cast body, air nozzle and back plate used in the fixed body construction burner. The fixed body construction also enables the same body to be used with different sized air nozzle and atomizing assemblies, thereby reducing inventory required for burners of varying capacities.

The disassembled burner components are easily serviced. The atomizing assembly is disconnected from the back plate, serviced and then reconnected to the back plate with its gas flow bores returned to their original angular orientation with respect to the back plate. The back plate and air nozzle include a lug and slot connection which assures that secondary air flow bores in the air nozzle are returned to their original angular orientation with respect to the back plate. Upon assembly of the burner, the connection assures that the gas flow openings in the atomizing assembly are returned to their same angular orientation with respect to the secondary air flow openings in the air nozzle. In this way, the burner can be placed back in operation following servicing without having to readjust the gas flow system to maintain a desired ratio of gas flow to air flow at different burns.

Accordingly, it is an object of the invention to provide a fixed body construction low-capacity combination oil and gas fired burner.

Another object of the invention is to provide an improved low-capacity combination oil-gas fired burner which is readily disassembled for cleaning and may be reassembled with fluid and secondary air flow openings returned to their original relative locations to assure the reassembled burner has the same combustion characteristics as originally set up.

A further object of the invention is to provide a fixed body construction burner having a cast body, air nozzle and back plate.

Other objects and features of the invention will become apparent as the description proceeds, especially when taken in conjunction with the accompanying drawings illustrating the invention, of which there are three sheets.

IN THE DRAWINGS

Figures 3, 4:
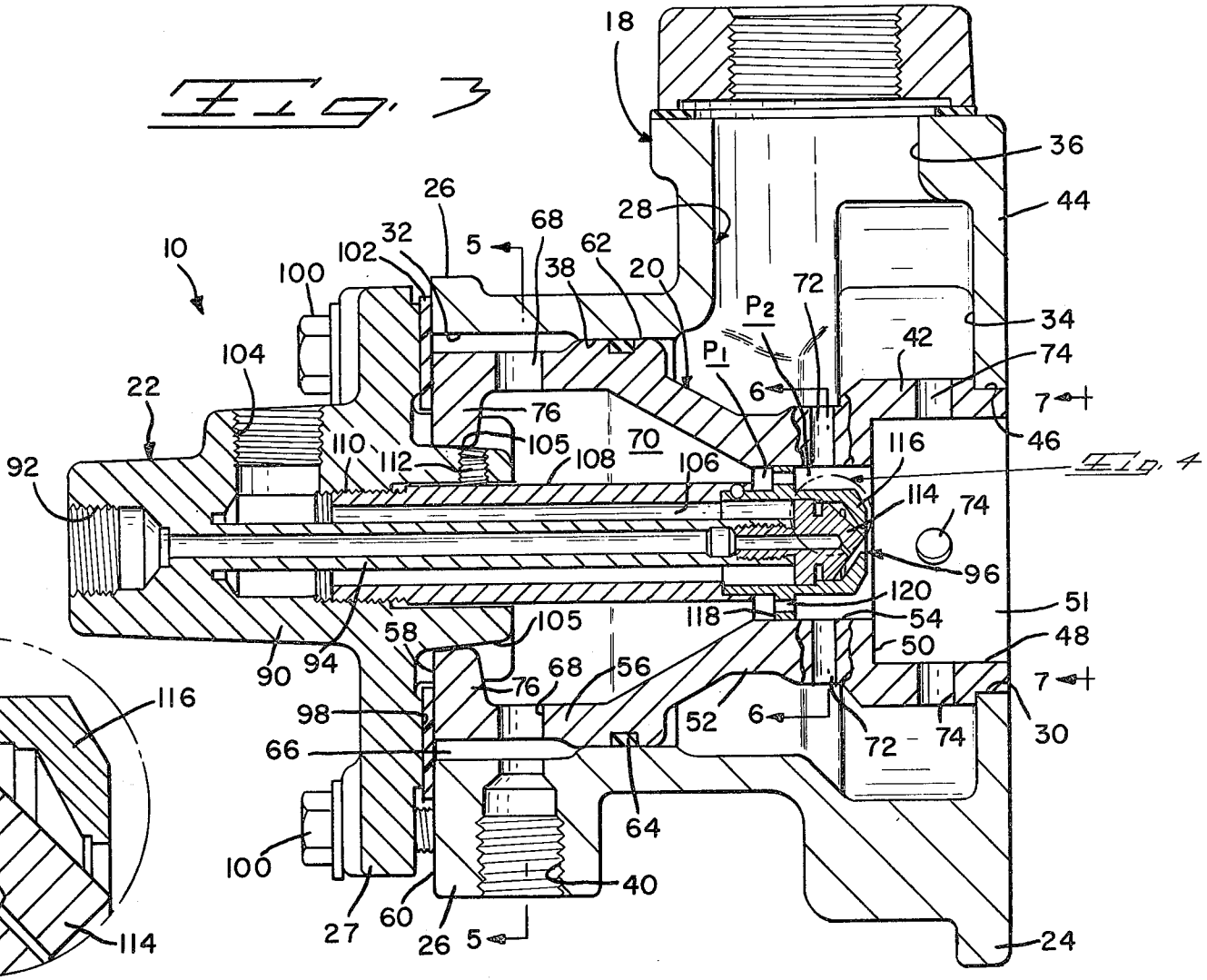
FIG. 3 is a vertical sectional view through the burner.
FIG. 4 is an enlarged view of a portion of FIG. 3.
Figure 5:
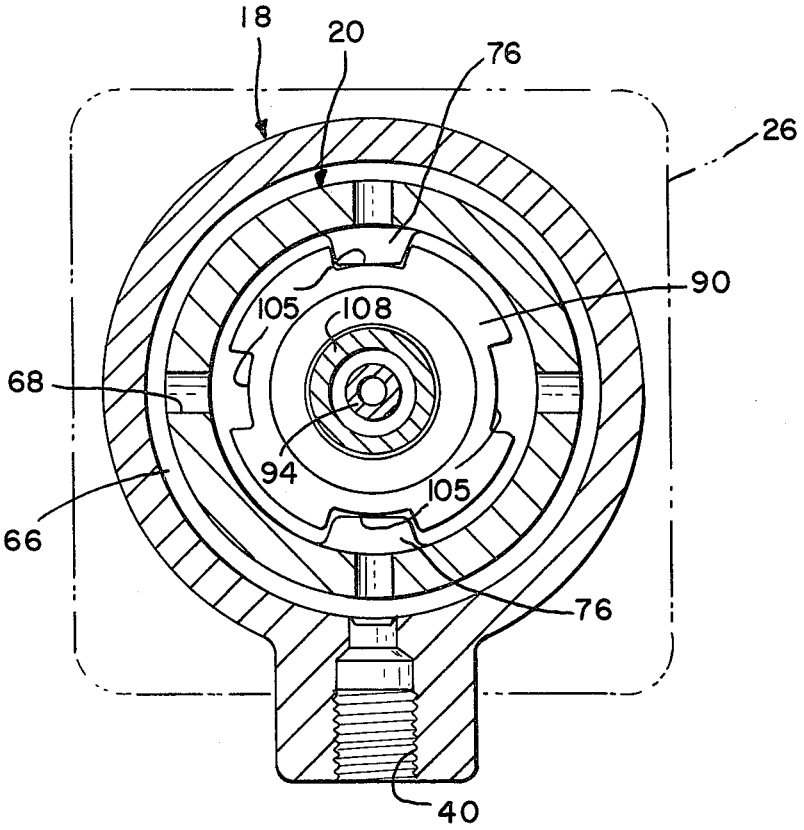
Figure 6:
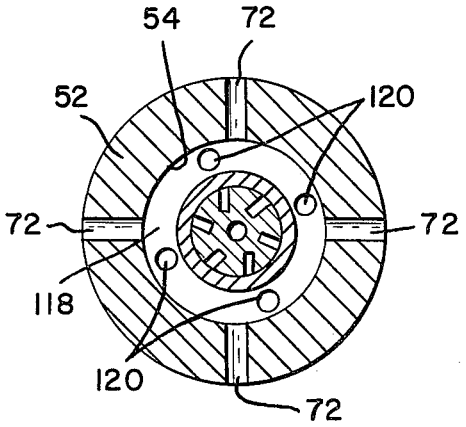
Figure 7:
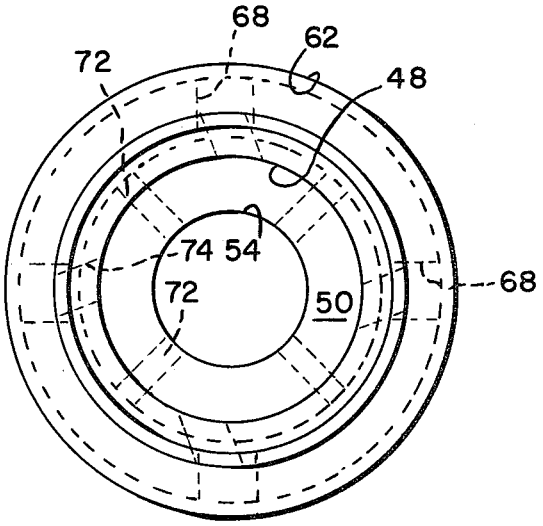

FIGS. 5, 6 and 7 are sectional views taken, respectively, along lines 5—5, 6—6 and 7—7 of FIG. 3.

DESCRIPTION OF THE BURNER

Figure 1:
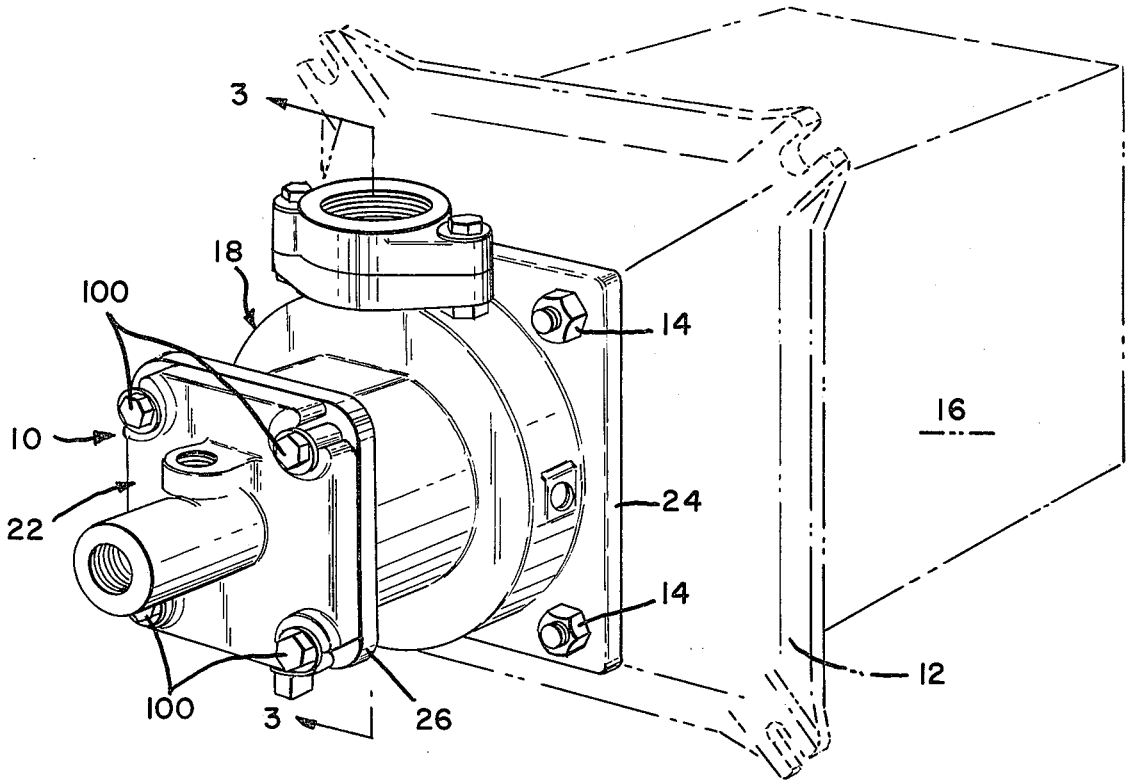
FIG. 1 is a perspective view of the burner according to the invention on a mounting plate and ignition tile.

FIG. 1 illustrates combination oil and gas fired burner 10 secured on one side of mounting plate 12 by stud and nut connections 14. Connections 14 sandwich the plate 12 between the burner and the tile. Tile 16 has an interior combustion area used to shape and retain the flame of burner 10.

As shown in FIG. 3, the burner 10 includes a cast body 18, a cast air nozzle 20 fitted within the interior of body 18 and an end or back plate 22 on the back of the body away from mounting plate 12. The body includes a front mounting flange 24 adjacent the plate 12 cooperable with the nut and bolt connections 14 for holding the burner on the plate and tile. End plate flange 26 is located on the end of the body adjacent the end plate. The body has a hollow interior 28 communicating with a cylindrical opening 30 at the discharge or front end of the burner and a larger diameter cylindrical opening 32 at the inlet or back end of the burner. An enlarged interior opening 34 is formed in body 18, surrounds opening 30 and is in communication with secondary air inlet port 36 formed in the top of the body adjacent flange 24. The interior 28 of body 18 also includes a cylindrical section 38 between opening 32 and the inlet port having an interior diameter slightly less than that of opening 32. Openings 30, 32 and surface 38 are concentric. A gas inlet port 40 extends through the body 18 to opening 32.

With the back plate removed from the body, the air nozzle 20 may be inserted within the interior opening 28 as shown in FIG. 3. The air nozzle includes a cylindrical end 42 adjacent the front body wall 44. Reduced diameter step 46 formed in the end 42 fits snugly within opening 30 to limit axial movement of the air nozzle from the position shown in FIG. 3. If desired, a seal may be applied at the fit between the step and opening to assure the connection is air-tight.

The interior surface 48 of end 42 extends upstream from wall 44 to a radially inward wall 50 leading to cylindrical portion 52 defining interior cylindrical surface 54 at the radial inner end of step 50. Step 50 and surface 48 define a combustion chamber 51. Upstream of portion 52 the diameter of the air nozzle increases frustroconically, to a circular portion 56 having an upstream face 58 essentially coplanar with the upstream surface 60 of flange 26. The exterior of the air nozzle includes a cylindrical surface 62 having a sliding fit with interior surface 38 of body 18. The air nozzle carries a sealing gasket 64 in a groove in surface 62 to form a desired gasproof joint between the air nozzle and body. The exterior surface of the nozzle is reduced between surface 62 and end surface 58 to cooperate with body surface 32 in defining an annular gas flow passage 66 communicating with gas inlet port 40.

The air nozzle includes four 90°-spaced gas flow bores 68 formed through portion 56 to communicate the passage 66 with the nozzle interior 70. A second set of four 90°-spaced secondary air bores 72 extends through air nozzle portion 52 to communicate the secondary air inlet port 36 with the interior of the air nozzle downstream of the oil atomizing assembly. Four 90°-spaced secondary air bores 74 extend through the air nozzle portion 42 to communicate the secondary air inlet port 36 with the cylindrical chamber 51. The bores 74 are all angled slightly to one side of radial lines so that the secondary air flowing through them imparts swirling motion to the combustion mixture in chamber 51. The bores 72 are 45° offset from bores 68 and 74 as shown in FIG. 7. The air nozzle includes a pair of 180°-opposed orienting lugs 76 which extend radially inwardly of portion 56 at surface 58. See FIGS. 3 and 5.

The back plate 22 includes generally cylindrical central portion 90 having a fuel oil inlet port 92 on the inlet or back end thereof with an integral small diameter oil pipe 94 extending from the port to atomizing assembly 96 located downstream of the back plate. Flange 27 extends outwardly of portion 90 and includes a flat sealing surface 98 opposite surfaces 58 and 60 and suitable slots for bolts 100 which are threaded into the body 18 to secure the back plate against the body and hold the air nozzle in place within the body. A suitable gasket 102 forms a tight seal between a back plate and the upstream surfaces of the body.

Back plate portion 90 includes a primry air inlet port 104 leading to a primary air flow path 106 between the oil pipe 94 and the primary air pipe 108. The primary air pipe is secured to central portion 90 by thread connection 110 and is locked to the back plate by set screw 112.

The atomizing assembly 96 includes an oil nozzle 114 threadably secured to the downstream end of oil pipe 94 so that it abuts the end of the pipe. The assembly also includes an air nozzle 116 fixably secured on downstream end of the primary air pipe 108. The air nozzle includes an outwardly projecting radial flange 118 having a sliding fit with interior surface 54 of the air nozzle 20. Four 90°-spaced gas flow bores 120 extend through flange 118 to permit gas to flow from port 40 through passage 66, bores 68, interior 70 of the nozzle to the combustion chamber 51.

As shown best in FIG. 4, the primary air pipe 108 is threaded into the back plate 22 at threaded connection 110 until the interior step 122 on air nozzle 116 abuts the downstream edge 124 of the oil nozzle flange 126. The set screw 112 may then be tightened to hold the primary air tube and air nozzle in place.

The back plate portion 90 downstream of flange 26 is provided with four 90°-spaced recesses 105, each dimensioned to have a sliding fit with the opposed orienting lugs 76 on the air nozzle 20. With the burner assembled as in FIG. 3, lugs 76 have a sliding fit with a pair of recesses 105 and serve to orient the air nozzle 20 angularly with respect to the back plate. This positive angular orientation assures that when the burner is disassembled for servicing and then reassembled, the four gas flow bores 120 are returned to the same angular orientation with respect to the four secondary air flow bores 72.

Figure 2:
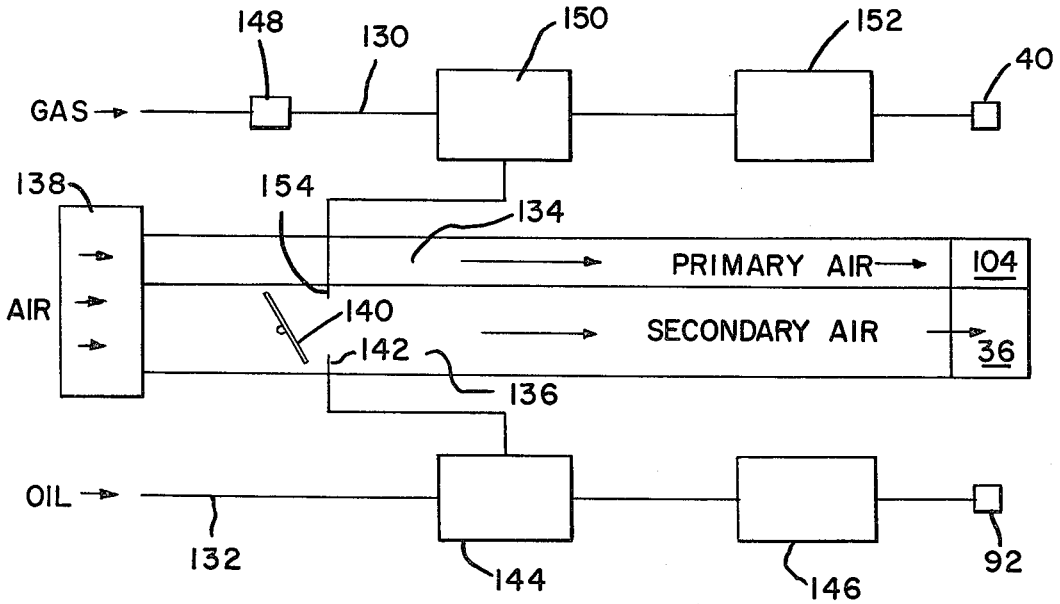
FIG. 2 is a diagrammatic view of the primary and secondary air lines and oil and gas lines leading to the burner, including certain controls used in operating the burner.

FIG. 2 diagrammatically illustrates the controls provided on the gas and oil flow lines 130 and 132 of burner 10. The primary air and secondary air flow lines 134 and 136 are connected at the upstream ends to a constant pressure air source 138 and at their downstream ends to the primary air and secondary air inlet ports 104 and 36. A butterfly valve 140 located in the secondary air line 136 modulates the flow of secondary air. The setting of this valve determines whether the burner operates at high, low fire or at an intermediate fire. Oil line pressure sensor 142 located downstream of valve 140 controls oil line regulator 144 so that the desired ratio of oil flow to air flow is maintained by the regulator at different burns or firing rates. In this way, the regulator 144 varies the downstream oil pressure in proportion to the setting of valve 140.

An oil trim valve 146 is located in oil line 132 downstream of regulator 144. During initial installation of burner 10, this valve is adjusted to provide the desired oil flow to the burner at high burn. The downstream end of the oil line 132 joins oil inlet port 92 on the back plate.

The gas line 130 extends from a pressure source of gas through on-off valve 148, gas regulator 150 and gas trim valve 152. The dosntream end of the gas line is connected to the gas inlet port 40.

A gas pressure sensor 154, similar to sensor 142, is located downstream of valve 140 and operates regulator 150 to control downstream pressure in gas line 130 according to the position of valve 140. Trim valve 152 is set to provide desired flow of gas to the burner at a high burn.

OPERATION OF THE BURNER

Burner 10 has an operating range from a high burn btu output of about 100,000 to 200,000 btu per hour and low burn btu output of about from 30,000 to 50,000 btu per hour. The burner may be used in a number of applications requiring an input in this range, including heat-treating furnaces, food-processing ovens, ceramic and refractory furnaces, textile dryers, and the like.

Burner 10 is fueled by either or both gas or oil. When burning oil, the oil flows from oil inlet 92 through pipe 94 to the atomizing assembly 96 where it is mixed with primary air flowing from primary air inlet 104 through primary air passage 106 to the atomizing assembly. The oil-primary air mixture is swirled and burned in chamber 51 and the combustion chamber of refractory tile 16. At higher burns, secondary air flows through secondary air inlet port 36 and passages 72 and 74 to mix with the oil-rich spray from the atomizing assembly. The secondary air passing through bores 74 provides swirl to the air-oil mixture and resultant flame.

Gas used to fuel burner 10 flows from the gas inlet port through bores 120 to chamber 51. At low burn, the gas mixes with primary air flowing outwardly of the atomizing assembly 96 and at higher burns mixes with the primary air and increased amounts of secondary air flowing into chamber 51 through passages 72 and 74.

Upon initial installation of the burner, it is necessary to adjust the burner controls to tune the burner to the operating parameters of the particular installation. This is done by separately tuning the burner for oil fire operations and tuning it for gas fire operation. Initially, the valve 140 is adjusted to provide the calculated secondary air for high burn operation.

Oil fire tuning is performed by using a suitable chart to calculate the theoretical ratio of oil flow to air flow at high burn and then adjusting the trim valve 146 to this theoretical setting. Valve 140 is then turned to a low burn position, oil is supplied to line 132 and the burner is ignited by use of a pilot light (not illustrated) extending through plate 12 into the combustion chamber within refractory tile 16. After ignition, the regulator 144 is adjusted to the required low fired fuel flow rate.

After the burner has ignited at low burn, valve 140 is rotated to the high burn position and the trim valve 146 and regulator 144 may be alternately adjusted to maximize the efficiency of burner 10 at high burn.

The burner is adjusted for gas burn operation by calculating the theoretical ratio of air flow to gas flow at high burn and setting trim valve 152 accordingly. The butterfly valve 140 is set at a low burn position, on-off valve 148 is opened and the pilot flame ignites the burner at low burn. Valve 140 is then opened to high burn and the gas flow rate through line 130 is checked to tune the burner for optimum high burn performance. The trim valve 152 may be adjusted to obtain the desired gas flow. Regulator 150 is not adjustable.

Referring now to FIGS. 3 and 4, the gas flow rate through burner 10 is controlled by the pressure difference across the atomizer assembly flange 118. If the pressure above the flange is $P_1$ and the pressure immediately below the flange is $P_2$, the gas flow rate is the product of a near constant times ($P_1$ less $P_2$). $P_2$, however, varies depending upon the relatively angular positions of the gas bores 120 and the secondary air bores 72. FIG. 6 illustrates the gas flow bores 120 oriented at an angle of approximately 20° counterclockwise of the secondary air flow bores 72. The pressure $P_2$ is at a minimum when the angle between the sets of bores is 0° and the gas bores 120 are in line with the secondary air bores 72. The pressure $P_2$ is at a maximum when the gas flow bores are at 45° to the secondary air bores.

Thus, it is apparent that the gas flow rate for the given burner 10 is dependent upon the angular orientation between the sets of bores 72 and 120. When the burner is initially tuned for the gas operation, trim valve 152 is adjusted to provide a suitable gas flow to the burner. This adjustment is easily made during initial installation and setup of the burner.

Burner 10 is periodically disassembled and serviced, requiring removal of the back plate, air nozzle and disassembly and cleaning of the burner parts. Disassembly is easily achieved by removing the back plate and air nozzle without the necessity of removing the burner body from the mounting plate 12. In this way, a large number of the auxiliary components of the burner can be left in place and need not be disturbed.

Upon reassembly of the burner, the oil atomizer 114 is threaded into the downstream end of the oil pipe 94 until the upstream surface 128 of flange 126 bottoms on the end of the oil pipe 94. The primary air pipe 108 and attached air nozzle 116 are then placed over the oil pipe and oil nozzle and the air pipe is threaded into the back plate at threaded connection 110 until the step 122 bottoms on the upstream edge 124 of the flange 126. The set screw 104 is then tightened to hold the primary air pipe and atomizing assembly in place on the back plate. The positive seating of the air nozzle 116 against the downstream surface of oil nozzle flance 126 assure that upon reassembly the gas bores 120 are returned to the same angular orientation with respect to the back plate 22 and orienting lugs carried on the back plate that they had prior to disassembly.

On continued assembly of the burner, the air nozzle 20 is positioned within the body 18, the gasket 102 is positioned on surfaces 58 and 60 and the back plate is moved downstream to pilot the atomizing assembly 96 within surface 54 and move an opposed pair of recesses 105 over the air nozzle lugs 76. Since the four gas flow bores 120 have been returned to the original angular orientation with respect to the four recesses 105 of the back plate, positive angular reorientation of the air nozzle bores 72 with respect to bores 120 is assured by seating lugs 76 in a pair of opposed recesses 105. In this way, the air nozzle is held in one of four 90°-positions with respect to the back plate and the secondary air flow bores 72 are returned to their original angular position with respect to the gas flow bores 120 when the burner was initially set up. This means that the burner can be disassembled, serviced and reassembled without the necessity of resetting the gas trim valve 152.

While we have illustrated and described the preferred embodiments of our invention, it is understood that these are capable of modification, and we therefore do not wish to be limited to the precise details set forth, but desire to avail ourselves of such changes and alterations as fall within the purview of the following claims.

What we claim our invention is:

1. A combination gas and oil fired burner comprising a hollow body having a downstream end wall with a downstream opening therein, an upstream end with an upstream opening therein aligned with the downstream opening, a gas inlet port extending through the body adjacent the upstream opening, and a secondary air inlet port extending through the body adjacent the downstream opening; a hollow open-ended nozzle extending between said openings within the interior of the body and having a downstream end opening into the downstream opening to communicate the interior of the nozzle with the exterior of the body through such opening, an upstream end adjacent the body upstream end, a gas flow opening through the thickness of the nozzle communicating the gas inlet port with the interior of the nozzle, the nozzle including a reduced interior cross section portion adjacent the nozzle downstream end; an end plate having a primary air inlet port and an oil inlet port; removable securing means for holding the end plate on the upstream end of the body to sandwich the nozzle between the end plate and the body downstream end wall; an oil passage within the nozzle interior extending downstream from the oil inlet port; a primary air passage within the nozzle interior extending downstream from the primary air inlet port; and an atomizing assembly on the downstream ends of said passages and within the reduced interior cross section portion of the nozzle, a gas flow opening in said portion extending past the atomizing assembly to communicate the interior of the nozzle with the exterior of the body through the downstream body opening, and a secondary air flow opening through the nozzle downstream of the gas flow opening at the atomizing assembly to communicate the secondary air inlet port with the downstream end of the nozzle.

2. A combination gas and oil fired burner as in claim 1 wherein the nozzle is fitted within the body from the upstream end so that upon removal of the end plate and atomizing assembly the nozzle may be removed from the interior of the body through the body upstream end.

3. A combination gas and oil fired burner as in claim 1 wherein the nozzle includes a combustion chamber at the downstream end thereof, the atomizing assembly opens into said chamber and including a plurality of circumferentially spaced secondary air flow openings extend through the sidewall of the chamber, said openings all being angled to one side of radial lines so that secondary air flowing through such bores swirls the combustion mixture within the chamber.

4. A combination gas and oil fired burner as in claim 3 wherein the nozzle is spaced from the body adjacent the end plate to define an annular gas flow passage therebetween, said gas inlet port communicating with said passage, and a plurality of circumferentially spaced gas flow openings communicating said passage with the interior of the nozzle upstream of the atomizing assembly.

5. A combination gas and oil fired burner as in claim 4 wherein said body, nozzle and end plate are cast parts.

6. A combination gas and oil fired burner as in claim 1 wherein the atomizing assembly includes a circumferential flange having a sliding fit within the reduced cross section portion of the nozzle, the nozzle is generally circumferentially symmetrical about an upstream-downstream axis and includes at least N secondary air flow openings regularly spaced around the circumference of the nozzle downstream from the atomizing assembly flange, the flange including at least N gas flow openings extending therethrough regularly spaced around the circumference of the flange, the burner including positive circumferential orienting means for the atomizing assembly flange whereby the atomizing assembly may be removed from the back plate, serviced and reassembled with the gas flow openings in the flange returned to their original circumferential position with respect to the bace plate, either said back plate or nozzle including N circumferentially spaced locating members adjacent the upstream end of the nozzle, the other of said back plate or nozzle including a locating member engageable with any one of said N locating members to permit disassembly of the back plate from the nozzle and reassembly with the secondary air flow openings returned to their original circumferential orientation with respect to the back plate whereby the burner may be disassembled for servicing and reassembled with retention of the original circumferential augular orientation between the gas flow openings and the secondary air flow openings.

7. A combination gas and oil fired burner as in claim 6 wherein the end plate includes N circumferentially spaced downstream facing orienting recesses and the nozzle includes at least one orienting lug engageable with one of said recesses so as to angularly orient the nozzle with respect to the end plate in one of N positions.

8. A combination gas and oil fired burner as in claim 7 wherein N is four.

9. A combination gas and oil fired burner including a hollow body, an open-ended nozzle symmetrial about an upstream-downstream axis fitted within the interior of the body and extending from the upstream to the downstream ends thereof, an end plate on the upstream end of the body confining the nozzle within the body interior, and an atomizing assembly carried by the end plate and extending downstream into the interior of the nozzle, an oil inlet port and a primary air inlet port on the end plate both communicating with the atomizing assembly, a gas inlet port in the body, a gas flow passage communicating the gas inlet port with the interior of the nozzle upstream of the atomizing assembly, at least N gas flow openings circumferentially spaced around the atomizing assembly and communicating the interior of the nozzle with the downstream exterior of the burner, a secondary air inlet port on the body adjacent the downstream end, at least N secondary air flow openings extending through the nozzle downstream of the gas flow openings, the end plate and atomizing assembly including means for assembly and disassembly of the atomizing assembly from the back plate so that upon reassembly the N gas flow openings are returned to their original angular position with respect to the back plate, and an orienting connection joining the nozzle and the back plate in one of N circumferentially spaced positions whereby upon disassembly of the burner for servicing and subsequent reassembly, the gas flow openings are returned to their original angular position with respect to the secondary air flow openings.

10. A combination gas and oil fired burner as in claim 9 wherein said orienting connection directly joins nozzle and back plate.

11. A combination gas and oil fired burner as in claim 10 wherein the orienting connection includes N features on one of said back plate or nozzle and at least one complementary feature on the other of said back plate or nozzle, said one feature engaging one of said N features.

12. A combination gas and oil fired burner as in claim 11 wherein N is even and said other of said back plate and nozzle includes two diammetrically opposed orienting features.

13. A combination gas and oil fired burner as in claim 12 wherein N is four.

14. A combination gas and oil fired burner as in claim 9 wherein said nozzle has a sliding fit within the interior of the body and the exterior radius of the nozzle at a given point is less than the interior radius of the body upstream from said point whereby the nozzle may be freely moved into and out of the body through the upstream body and after removal of the end plate.

* * * * *